US005304280A

United States Patent [19]

Stokes et al.

[11] Patent Number: 5,304,280

[45] Date of Patent: Apr. 19, 1994

[54] METHOD AND APPARATUS FOR RE-EPOXYING RADIATOR HEADER PLATE TO CORE TUBES

[76] Inventors: Dyrell K. Stokes, Rte. 3 Box 1354; Bennie J. Stokes, 1031 W. Verdine, both of Sulpur, La. 70663

[21] Appl. No.: 22,292

[22] Filed: Feb. 25, 1993

[51] Int. Cl.[5] ..... B32B 35/00; B23P 15/26; F24J 3/00

[52] U.S. Cl. ..... 156/584; 29/890.03; 29/726; 219/521; 432/225; 432/227; 432/231

[58] Field of Search ..... 156/381, 538, 584, 94; 29/890.03, 890.031, 726, 726.5, 727; 432/225, 227, 231; 219/521, 524, 535, 520

[56] References Cited

U.S. PATENT DOCUMENTS

| | | | |
|---|---|---|---|
| 1,405,340 | 1/1922 | Schulz | 432/231 |
| 1,410,410 | 3/1922 | Schulz . | |
| 3,149,825 | 9/1964 | Watkins . | |
| 3,193,262 | 7/1965 | Huffman, Jr. et al. | 432/225 |
| 3,726,466 | 4/1973 | Vedder et al. . | |
| 3,785,026 | 1/1974 | Ohmstede | 29/890.031 |
| 3,828,412 | 8/1974 | Dreksler . | |
| 4,371,106 | 2/1983 | Chapman . | |
| 4,456,819 | 6/1984 | Ballard | 432/231 |
| 4,504,223 | 3/1985 | Yamada et al. | 432/225 |
| 4,769,888 | 9/1988 | Desiro | 29/726 |
| 4,830,259 | 5/1989 | Lewis | 29/726 |

*Primary Examiner*—Michael W. Ball
*Assistant Examiner*—R. Robey
*Attorney, Agent, or Firm*—Jacobson, Price, Holman & Stern

[57] ABSTRACT

A support is provided for supporting the lower header plate and adjacent tube ends of a radiator core within an oven area for even heating thereof preparatory to manually pry and scrapping softened epoxy material from the header plate and about the tube ends. A method also is incorporated wherein after the original epoxy has been removed, fresh epoxy is applied to the header plate about the tube ends and allowed to cure.

12 Claims, 2 Drawing Sheets

METHOD AND APPARATUS FOR RE-EPOXYING RADIATOR HEADER PLATE TO CORE TUBES

BACKGROUND OF THE INVENTION

1. Field of the Invention

This invention relates to an apparatus for supporting, alternately in upright and inclined positions, a radiator core and includes structure whereby the lower header plate of the radiator core and the adjacent tube ends may be contained within a substantially closed oven into which heated air may be introduced, the heating of the lower end plate and the adjacent tube ends serving to soften the epoxy bonding the tube ends to the header plate in order that the epoxy may be removed. The invention also incorporates the method steps carried out through the utilization of the apparatus for re-epoxying a header plate to the corresponding tube ends.

2. Description of Related Art

Various different forms of radiator supports and methods and apparatuses for joining aluminum heat exchange coils through the utilization of epoxy heretofore have been known. Examples of these previously known apparatuses are disclosed in U.S. Pat. Nos. 1,410,410, 3,149,825, 3,726,466, 3,828,412 and 4,371,106. However, these previously known devices do not include the laterally slidable as well as pivotal oven component of the instant invention, various other components of the apparatus, nor a method of re-epoxying radiator core tube ends to end plates by heating the original epoxy for removal thereof and re-applying new epoxy.

SUMMARY OF THE INVENTION

The apparatus of the instant invention includes a stand from which a radiator core may be supported in an upright or inclined position and the stand includes a support against which the lower end of the supported radiator may rest while enclosed within an oven for heating the radiator core lower end plate and adjacent tube ends. A heat source is laterally shiftable relative to the stand and also swingable into and out of position in alignment with the air intake of the oven. Further, the oven is mounted for swinging to an out of the way position whereby only the discharge of the heat source may be registered with and moved along the lower inner plate of a radiator core supported from the stand.

The main object of this invention is to provide a method and apparatus by which radiator cores having their tube ends epoxyed to end plates may be repaired by removal of the original epoxy and re-application of new epoxy in order to insure a fluid and pressure tight seal between the associated end plate and the corresponding tube ends.

Another object of this invention is to provide an apparatus including an upwardly opening channel shaped oven downwardly into which the lower header plate of a radiator core may be received and with the oven including adjustable plates supported therefrom whereby the dimensions of the interior of the oven and the opening thereof may be adjusted according to the size of the radiator core being worked upon.

Another very important object of this invention is to provide an apparatus which may be utilized by relatively unskilled persons in order to accomplish proper re-epoxying of radiator core end plates.

A final object of this invention to be specifically enumerated herein is to provide a method and apparatus for carrying out the stated objective and which apparatus will conform to conventional forms of manufacture, be of simple construction and easy to use so as to provide a device that will be economical feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
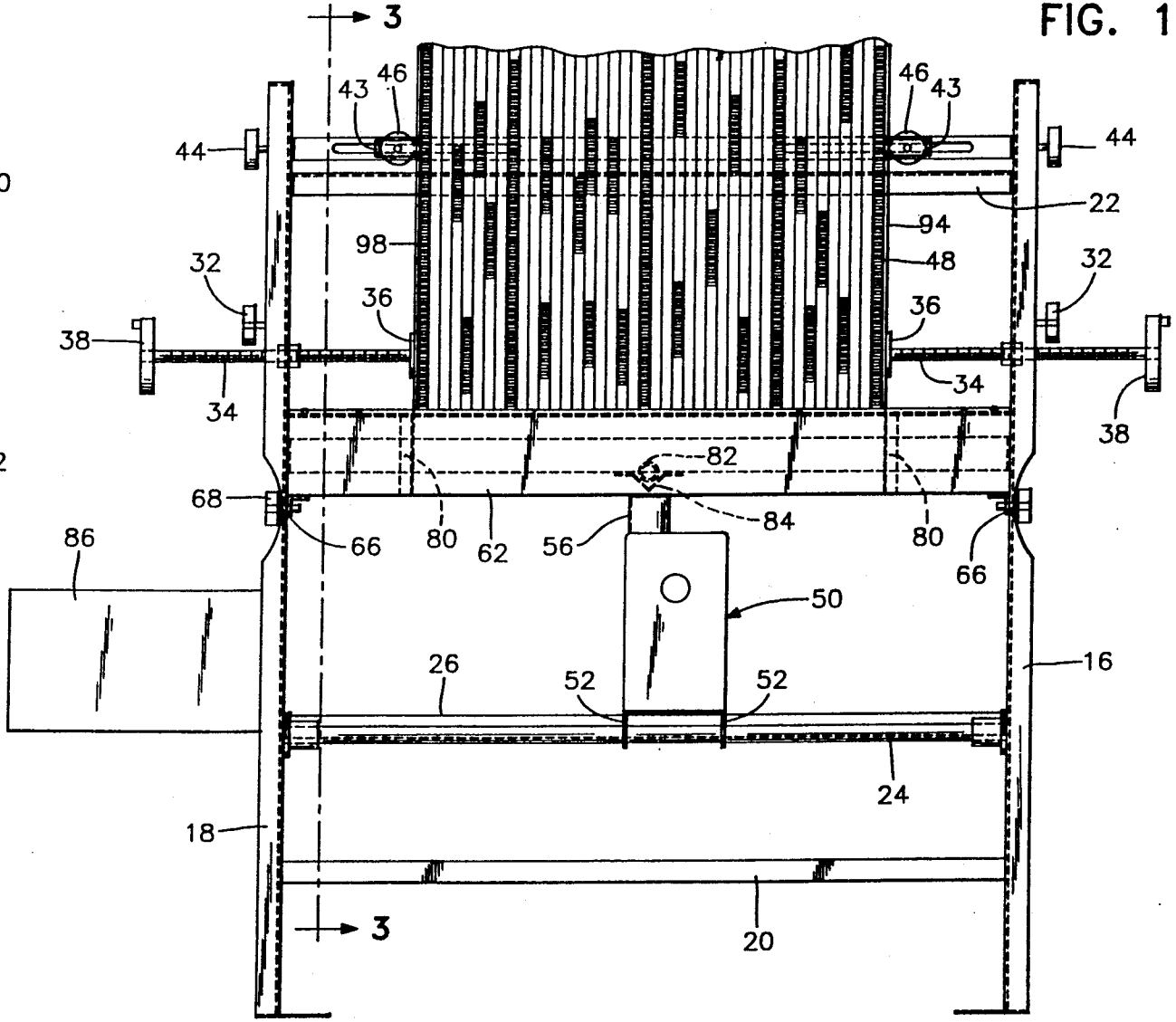
FIG. 1 is a front elevational view of the apparatus of the instant invention by which one or more header or end plates of a radiator may be re-epoxyed to the corresponding tube ends.

Referring now more specifically to the drawings the numeral 10 generally designates a radiator support having front and rear sides 12 and 14 and incorporating a pair of upstanding opposite end plates 16 and 18 interconnected by a lower shelf 20, an upper angle bracket 22, a support pipe 24, a lower angle bracket 26 and an intermediate level support bracket 28.

A pair of opposite side support assemblies 30 are mounted upon the end plates 16 and 18 for fore and aft shifting and are releasably securable in adjusted shifted position through the utilization of clamp screws 32, the support assemblies 30 mounting threaded clamp screws 34 therefrom including inner end radiator engaging heads 36 and outer end cranks 38.

The upper portions of the end plates 16 and 18 include horizontal front-to-rear extending slots 40 by which a support angle bracket 42 is supported between the upper ends of the end plates 16 and 18, a pair of clamp screws 44 being provided for releasably retaining the angle or abutment bracket 42 in adjusted fore and aft shifted position. In addition, a pair of clamps 43 are slidably mounted upon the angle bracket 42 for adjustable shifting thereon and include clamp screws 46 whereby a radiator core 48 having its lower end portion resting upon the support bracket 28 as shown in FIG. 3, its opposite sides clamped between the heads 36 as shown in FIG. 1 and its upper end abutted against the angle bracket 42 may be clamped in such position, whether the angle bracket 42 is shifted rearwardly such that the radiator core 48 is upwardly and rearwardly inclined, or whether the angle bracket 42 is shifted to the foremost extremities of the slots 44 such that the radiator core 48 may be supported from the support bar or bracket 28 in an upright position, the clamp screws 34 being fore and aft shiftable according to the positioning of the radiator core 48.

A heat source referred to in general by the reference numeral 50 and comprising an electrical resistance heater and fan assembly is pivotally supported from the support pipe 24 through the utilization of support brackets 52 depending downwardly from the heat source 50 and the heat source 50 is also slidable longitudinally of the support pipe 24, the front wall of the heat source 50 being provided with a handle 54. Also, the upper wall of the heat source 50 includes a heated air outlet neck 56.

The end plates 16 and 18 also include upwardly concave adjustment slots 60 formed therein and an elongated channel shaped oven 62 is snugly received between the end plates 16 and 18 and pivotally supported therefrom as at 64, the lower forward corners of the oven 62 including depending tabs 66 with which clamp screws 68 are threaded engaged, the clamp screws 68 passing through and being slidable along the arcuate slots 60.

Figure 2:
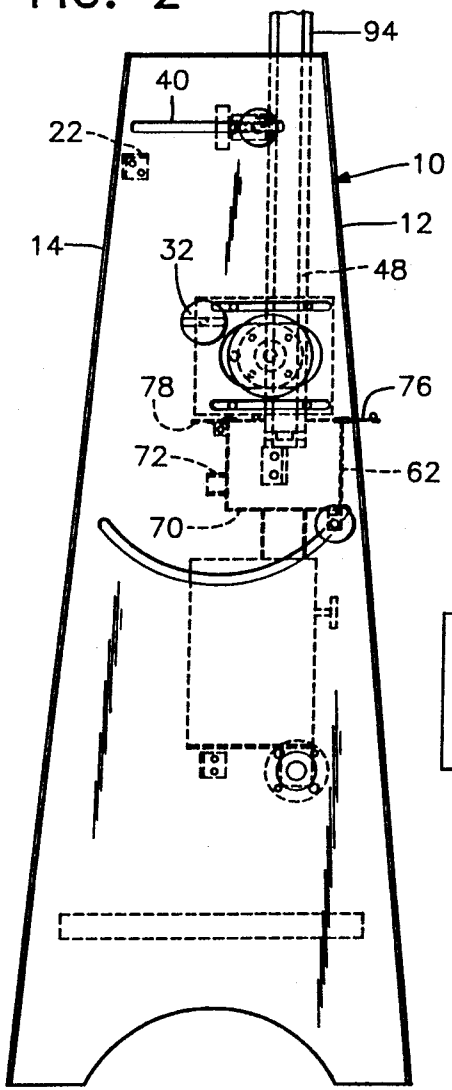
FIG. 2 is a left side elevational view of the assemblage illustrated in FIG. 1 with the electrical control box removed.
Figure 3:
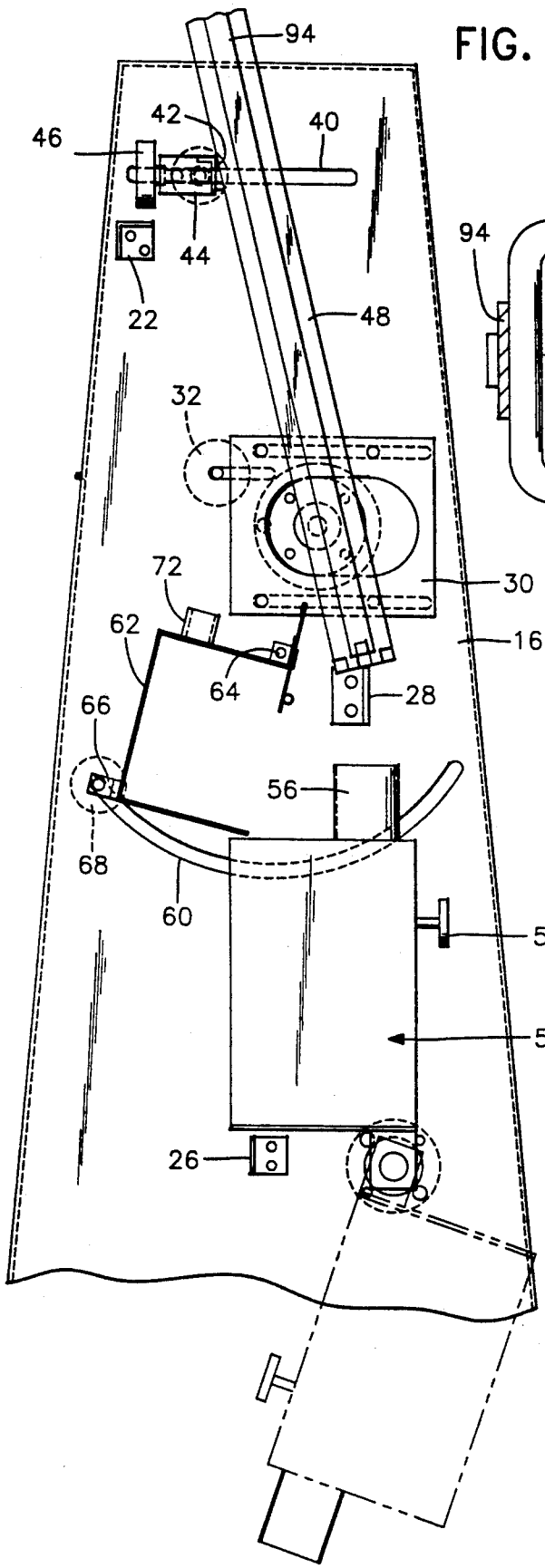
FIG. 3 is an enlarged fragmentary vertical sectional view of the stand taken substantially upon the plane indicated by the section line 3—3 of FIG. 2.

The oven 62 may be swung between the lowered and rearwardly displaced position illustrated in FIG. 3 with the clamp screws 68 disposed in the rear ends of the slots 60 and a forwardly and upwardly displaced operative position such as that illustrated in phantom lines in FIG. 2. Actually, the oven 62 may be swung forwardly and upwardly slightly pass the operative position thereof illustrated in FIG. 2. When the oven 62 is swung to its full forward and uppermost position as determined by the forward ends of the slots 60, the heat source 50 may be swung from the forwardly and downwardly displaced position thereof illustrated in phantom lines in FIG. 3 to the upright operative position thereof illustrated in solid lines in FIG. 3 and phantom lines in FIG. 2. After the heat source 50 has been swung to the phantom line position thereof illustrated in FIG. 2, the oven 62 may be slightly lowered from its full upper forwardmost position such that the bottom wall 70 of the oven 62 may then have its inlet opening (not shown) registered with the upper outlet end of the heated air outlet 56 of the heat source 50. Therefore, the heat source 50 may discharge heated air, at approximately 750°-1000° F., into the oven 62, the oven 62 having an outlet 72 therefore which is smaller in diameter than the heated air outlet 56 of the heat source 50. In addition, when the oven 62 is in the operative position thereof illustrated in phantom lines in FIG. 2, the upper marginal portions of the front and rear walls thereof include front to rear slidable front and rear doors 76 and 78 which may be shiftable rearwardly and forwardly, respectively, into contact with the radiator core 48 in order to close the oven 62 about the front and rear sides of the radiator core 48. Still further, generally rectangular end plates 80 are removably received in the opposite ends of the oven 61 and include downwardly opening notches therein in which to receive the support bracket 28. The end plates 80 are slidable longitudinally of the oven 62 in order to close the opposite ends of the oven 62 against the opposite sides of the radiator core 48, the upper extremities of the end plates 80 being disposed slightly below the level of the doors 76 and 78.

The heat generated by the heat source 50 is under the control of a thermostat 82 disposed within the oven 62 above a heat deflector 84 registered with the heated air outlet 56 and the thermostat 82 controls the amount of heat discharged from the heat source 50 through an electrical control assembly 86 carried by the exterior side of the end plate 18.

Figure 4:
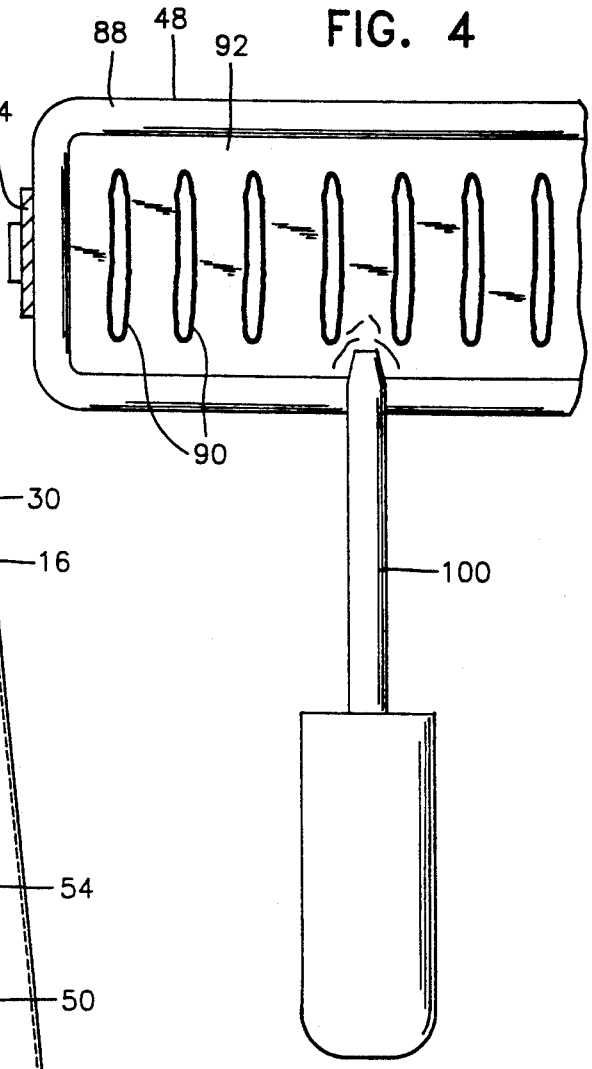
FIG. 4 is a fragmentary horizontal sectional view of the lower portion of a radiator core taken substantially upon a plane spaced immediately above the lower header or end plate of the radiator core and illustrating the manner in which a manual tools may be utilized to remove old epoxy once it has been heated sufficiently.

With attention now invited more specifically to FIG. 4, it may be seen that a typical radiator core 48 includes an aluminum bottom header or end plate 88 upwardly through which aluminum heat exchange tubes 90 project, the lower ends of the tubes 90 passing through openings provided therefore in the header plate 88 and being sealed relative thereto through the utilization of epoxy 92. Also, the radiator core 48 includes an upper header plate (not shown) corresponding to the header plate 88 and through which the upper ends of the tubes 90 are sealingly secured through the utilization of epoxy 92, the upper and lower header plates being interconnected by opposite side support straps 94 of the radiator core 98, which support straps 94 are engaged by the clamps screws 34. It will be noted that the epoxy 92 is applied to the header plate 88 about the corresponding ends of the tubes 90 on the "air side" of the header plate 88.

When using the support 10, the radiator core 48 may be mounted in the upright position thereof illustrated in FIG. 2 or the inclined position illustrated in FIG. 3, the inclined position being preferable in most cases.

After the radiator has been clamped in the mounted position thereof the front and rear doors 76 and 78 are inwardly shifted toward their maximum closed positions abutted against the radiator core 48 subsequent to the end pieces 80 being slid inwardly toward each other to abut the opposite side edges of the radiator core 48, the oven 62 already having been swung toward and locked in the phantom line position thereof illustrated in FIG. 2 and the heat source 50 having already been swung toward and locked into the position thereof illustrated in FIG. 2. Then, the heat sources is actuated so that heated air at generally 750°-1000° F. is discharged through the heated air outlet 56 and into the oven 62 against the deflector 84. Heated air is admitted into the oven for a period of approximately 8 minutes and then the front cover or door 76 is opened and a blunt pointed shank type tool 100 is used to pry up and loosen the softened epoxy 92 from the header plate 88. As the epoxy is being worked upon by the tool 100 while the front door 76 is open the temperature within the oven 62 is dropped to approximately 250° F.

When substantially all of the epoxy 92 has been removed from the near side of the header plate 88, the clamp screws 32 and 44 are loosened and the radiator core is removed and replaced in front to rear reversed positions after which the clamps 32 and 44 are again tightened and the front door 76 is inwardly closed to again raise the temperature within the oven 62 to approximately 450° F. for approximately four minutes. Then, the front door 76 is opened and the tool 100 is utilized to lift and pry the remaining softened epoxy from the header plate 88.

Thereafter, the oven 62 is lifted slightly upwardly past the operative position thereof illustrated in FIG. 2, the heat source 50 is swung slightly forwardly to clear the bottom of the oven 62 and then the oven 62 is swung rearwardly and upwardly and secured in the retracted position thereof illustrated in FIG. 3, after which the heat source 50 is returned to the position thereof illustrated in FIG. 3.

Thereafter, the heat source may be slid longitudinally of the support pipe 24 such that heated air discharged from the heated air outlet 56 is directed upon one end of the header plate 88 and the tool 100 again may be used to remove any epoxy remaining clinging to the header plate 88. Thereafter, the radiator core 48 is removed from the support and either sand or bead blasted in a further cleaning process. Still further, the adjoining surfaces of the header plate 88 and the tubes 90 may be cleaned with alcohol or epoxy remover of any suitable type.

Thereafter, the radiator core is reinstalled in the support 10 in the vertical position thereof illustrated in FIG. 2 and with the lower part of the radiator received within the oven 62 and the heat source 50 coupled therewith. The heating function of the heat source is deactivated and any remaining moisture on the lower portion of the radiator core 48 is air dried.

Then, a new supply of epoxy is injected over the air side surface of the header plate 88 about the lower ends of the tubes 90 and the oven is closed and the heat source is actuated for 20 minutes at approximately 250° F., for approximately 20 minutes at 200° F. or for approximately 40 to 45 minutes at 380° F., depending upon the type of epoxy being used. Thereafter, the heat element of the heat source 50 is deactivated and cooling air is blown from the outlet 56 into the oven 62 for cooling the newly applied epoxy such that the latter may fully solidify and form a fresh fluid tight seal between the air side surface of the header plate 88 and the adjacent tubes 90.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed is:

1. A radiator support for supporting a radiator in upstanding position while performing repair work thereon, said support including an elongated generally horizontal upwardly opening channel shaped oven, a generally horizontal support member mounted within said oven spaced below the open upper portion thereof for supporting, from beneath, a lower radiator header plate within said oven and with corresponding core tubes projecting upwardly from the header plate and expoxied thereto by epoxy surrounding the core tube lower ends above and bonded to the header plate, said oven including opposite ends and opposite longitudinal upstanding side walls, closure door means supported from an upper marginal portion of at least one of said side walls above said support member and adjustable inwardly thereof, a pair of opposite end pieces disposed within said channel shaped oven below said closure door means and adjustable therealong to adjust the effective length thereof to substantially the width of said radiator, and heating means operative to admit heating air into the interior of said channel shaped oven beneath said closure door means and between said end pieces, only, whereby said header plate, core tube lower ends and epoxy may be heated for sufficient softening of the latter to enable mechanical removal thereof from said header plate and core tube lower ends, said oven including restricted heated air outlet means below said open upper portion thereof.

2. The support of claim 1 wherein the other of said side walls also includes closure door means supported therefrom and adjustable inwardly thereof.

3. The support of claim 1 wherein said end pieces are received within said channel member beneath said closure door means.

4. The support of claim 3 wherein said heating means includes a hot air generator and means for discharging hot air generated thereby from said heating means and into said oven centrally intermediate the opposite ends thereof.

5. The support of claim 4 wherein said means for discharging hot air from said heading means includes means for discharging said hot air into said channel shaped oven at a level below said support member.

6. The support of claim 1 including at least one pair of opposing clamp means for clamping said radiator therebetween above said channel shaped oven along a path paralleling and disposed above said support member.

7. The support of claim 6 including a second pair of opposing clamp means for clamp engaging said radiator there between the first and second pairs of claim means being horizontally adjustable lateral of a vertical plane containing said channel shaped oven.

8. The support of claim 1 wherein said channel shaped oven is mounted from said support for downward and lateral shifting relative to said support member, said heating means including a hot air generator and means for discharging heated air therefrom upwardly towards said support member from beneath the latter, said heating means being mounted from said support for adjustable shifting relative thereto along a path generally paralleling said support member.

9. A radiator support for supporting a radiator while performing repair work thereon, said support including a generally horizontal support member for supporting, from beneath, a radiator header plate with core tubes projecting upwardly from said header plate and epoxied thereto by epoxy surrounding the core tube lower ends and bonded to the header plate, a generally horizontal upwardly opening oven in which said support member is disposed and including opposite ends and opposite longitudinal upstanding side walls, at least one of said side walls including means for reducing the effective width of the upper portion of said oven above said support member, said oven also including internal baffle means for adjusting the effective length of the interior thereof below said oven upper portion, and heating means for heating the interior of said oven between said baffle means only, whereby said header plate, core tube lower ends and epoxy may be heated for sufficient softening of the latter to enable mechanical removal thereof from said header plate and core tube lower ends.

10. The radiator support of claim 9 including a pair of laterally spaced, upstanding end plates, said support member extending between and stationarily supported from said end plates, said oven being generally channel-shaped and pivotally mounted between said end plates for swinging about a horizontal axis generally paralleling and spaced outwardly of the upper portion of one longitudinal side of said channel-shaped oven between a first raised upwardly opening operative position with said support member disposed generally laterally centrally in the upper portion of said channel-shaped oven below the upper extremity thereof and a second lowered, horizontally laterally opening position disposed to one side of a vertical plane in which said support member is disposed.

11. The radiator support of claim 10 wherein said generally horizontal and upwardly opening oven includes a downwardly opening heated air inlet, said heating means including an upwardly discharging heated air outlet for operative connection with said heated air inlet when said channel-shaped oven is in said first raised, upwardly opening operative position, said heating means being supported between said upstanding end plates for horizontal movement back and forth therebetween, whereby said heated air outlet may direct heated air therefrom upwardly toward and along said support member when said channel-shaped oven is swung from said first raised, upwardly opening operative position to said second lowered, horizontally laterally opening position disposed to one side of a vertical plane in which said support member is disposed.

12. A radiator support for supporting a radiator while performing repair work thereon, said support including a generally horizontal support member for supporting, from beneath, a radiator header plate with core tubes projecting upwardly from said header plate and epoxied thereto by epoxy surrounding the core tube lower ends and bonded to the header plate, said support including upstanding opposite end members, a generally horizontal upwardly opening oven in which said support member is disposed and including opposite ends and opposite longitudinal upstanding side walls, heating means for heating the interior of said oven whereby said header plate, core tube lower ends and epoxy may be heated for sufficient softening of the latter to enable mechanical removal thereof from said header plate and core tube lower ends, said support member extending between and being stationarily supported from said end members, said oven being generally channel-shaped and mounted between said end members for shifting between a first upwardly opening operative position disposed vertically beneath said support member and a second inoperative position disposed to one side of a vertical plane in which said support member is disposed, said channel-shaped oven including a downwardly opening heated air inlet, said heating means including an upwardly opening heated air outlet operatively communicated with said heated air inlet when said oven is in said operative position, said heated air outlet opening upwardly in a direction toward said support member, said heating means, including said heated air outlet, being supported between said end members for horizontal shifting therebetween and along said support member, whereby, when said oven is in said inoperative position, said heated air outlet may be shifted in position to maintain a localized area of the header plate of said radiator heated while softened epoxy may be mechanically removed therefrom.

* * * * *